US011498189B2

(12) United States Patent
Widmann et al.

(10) Patent No.: US 11,498,189 B2
(45) Date of Patent: Nov. 15, 2022

(54) WRENCH

(71) Applicant: Ham-let (Israel — Canada) Ltd, Ziporit (IL)

(72) Inventors: Amir Widmann, Ziporit (IL); Agmon David Porat, Ziporit (IL)

(73) Assignee: Ham-let (Israel — Canada) Ltd

( * ) Notice: Subject to any disclaimer, the term of this patent is extended or adjusted under 35 U.S.C. 154(b) by 0 days.

(21) Appl. No.: 17/594,429

(22) PCT Filed: Apr. 27, 2020

(86) PCT No.: PCT/IL2020/050474
§ 371 (c)(1),
(2) Date: Oct. 15, 2021

(87) PCT Pub. No.: WO2020/222230
PCT Pub. Date: Nov. 5, 2020

(65) Prior Publication Data

US 2022/0266425 A1 Aug. 25, 2022

(30) Foreign Application Priority Data

Apr. 28, 2019 (IL) ..... 266295

(51) Int. Cl.
*B25B 21/00* (2006.01)
*B25B 23/00* (2006.01)

(52) U.S. Cl.
CPC ..... *B25B 21/002* (2013.01); *B25B 23/0085* (2013.01)

(58) Field of Classification Search
CPC ..... B25B 13/08; B25B 13/48; B25B 13/481; B25B 13/488; B25B 13/50;
(Continued)

(56) References Cited

U.S. PATENT DOCUMENTS 4,382,730 A 5/1983 Reinisch
5,014,793 A 5/1991 Germanton et al.
(Continued)

FOREIGN PATENT DOCUMENTS

CN 204076123 U 1/2015
CN 106425968 A 2/2017
(Continued)

OTHER PUBLICATIONS

Written Opinion in corresponding International Application No. PCT/IL2020/050474, dated Jun. 18, 2020, in 6 pages.
(Continued)

*Primary Examiner* — Robert J Scruggs
(74) *Attorney, Agent, or Firm* — Knobbe, Martens, Olson & Bear, LLP

(57) ABSTRACT

A tool for sealing a workpiece, the workpiece comprising a first component and a second component sharing a rotation axis A, the tool comprising: a fastening head capable of engaging the first component; a first motor operationally coupled to the fastening head; a controller capable of: storing a rotation value representing rotation of the first component a predetermined desired angle around axis A; measuring movement of the first component, and controlling movement of the first motor; the tool, when the fastening head is engaged with the first component, and the second component is essentially immobilized from rotation around axis A, is configured to allow precisely sealing the workpiece by: rotating the first component in a closing direction R toward the second component, according to the rotation value and under the control of the rotation by the controller.

17 Claims, 6 Drawing Sheets

(58) Field of Classification Search
CPC ..... B25B 13/5008; B25B 13/5016; B25B 13/5025; B25B 13/5041; B25B 13/5058; B25B 17/00; B25B 17/02; B25B 21/00; B25B 21/002; B25B 21/008; B25B 21/02; B25B 23/00; B25B 23/0085
See application file for complete search history.

(56) References Cited

U.S. PATENT DOCUMENTS

| | | | | |
|---|---|---|---|---|
| 5,460,062 | A * | 10/1995 | Wilson, Jr. | B25B 13/48 81/57.3 |
| 5,526,460 | A | 6/1996 | Defrancesco et al. | |
| 6,680,595 | B2 | 1/2004 | Ito | |
| 2009/0120244 | A1* | 5/2009 | Lu | B25B 13/488 81/57.15 |
| 2016/0130123 | A1 | 5/2016 | Young | |
| 2018/0243887 | A1* | 8/2018 | Hohmann | B25B 23/1456 |
| 2019/0061115 | A1 | 2/2019 | Jokinen | |

FOREIGN PATENT DOCUMENTS

| | | | |
|---|---|---|---|
| CN | 206643833 | U | 11/2017 |
| CN | 206677853 | U | 11/2017 |
| CN | 109578663 | A | 4/2019 |
| CN | 208840846 | U | 5/2019 |
| DE | 10108672 | A1 | 11/2001 |
| FR | 2240083 | A1 | 3/1975 |
| GB | 1121003 | A | 7/1968 |
| GB | 1360472 | A | 7/1974 |
| GB | 1526947 | A | 10/1978 |
| GB | 2548390 | A | 9/2017 |
| KR | 20110137077 | A | 12/2011 |
| NZ | 205815 | A | 12/1986 |
| TW | 200900200 | A | 1/2009 |
| TW | 201923670 | A | 6/2019 |
| WO | 2020222230 | A1 | 11/2020 |

OTHER PUBLICATIONS

Search Report in corresponding International Application No. PCT/IL2020/050474, dated Jun. 18, 2020, in 4 pages.

* cited by examiner

WRENCH

CROSS-REFERENCE TO RELATED APPLICATIONS

This application is a national stage application under 35 U.S.C. § 371 of International Application No. PCT/IL2020/050474, filed on Apr. 27, 2020, which claims priority benefit of Israeli Patent Application No. 266295, filed on Apr. 28, 2019.

BACKGROUND

As a rule, the need to correctly and reversibly tighten high-pressure connectors exists throughout the world. High-pressure fittings that include various threaded elements such as nuts, bolts and ferrules need to be tightened based on physical actual movement to a specific prescribed extent such as a specific number of rotations, whereas most others are tightened to a prescribed torque. The specific movement activity is carried out according to precise instructions from the equipment manufacturers, which include several basic operations. All these operations are still done manually without any electrical or hydraulic aids.

There is a great need to reduce the physical strength that a worker uses to close the nuts. Automatic closing is required without the need for applying manual imprecise physical force and without marking—with a marker—the position of the nut before closing. In addition, today there is no automatic fixation of devices in the market in order to prevent the use of counterforce that can lead to mechanical distortions in the fitting system. The solutions available in this field today are completely manual and require additional mechanical assembly on existing tools. Building a new product that is both automatic and requires less human effort and ensures quality of closing automatically is necessary.

The description above is presented as a general overview of related art in this field and should not be construed as an admission that any of the information it contains constitutes prior art against the present patent application.

SUMMARY

This summary is provided to introduce a selection of concepts in a simplified form that are further described below in the detailed description.

This summary is not intended to identify key features or essential features of the claimed subject matter, nor is it intended to be used to limit the scope of the claimed subject matter.

According to one aspect, an improved tool to precisely tighten connectors is provided. The tool may be referred to below as "let-loker". We may refer to a hand-held part of this tool configured to allow physical engagement of the fitting as a "Handle".

According to one aspect, an improved tool for closing the connectors of various types is provided. The connectors today require manual closing with a manual key/wrench where a worker or a supervisor/quality assurance person needs to mark how many turns the worker did. This new tool allows to precisely tighten connectors to a specific angle where the information about the angles and the torque are stored digitally without any additional attention from the worker for the angle.

According to another aspect, an electrically controlled process is provided by which threaded elements requiring a precise number of turns are fastened together to form a correct, precise, repetitive and trackable joint. The improved tool may allow the following advantages:

One advantage of let-loker is the saving of work time, ease of effort and quality of assembly, which is better than offered by commercially available tools in the current market.

In detail:

Some embodiments may save over 80% of working hours per person per year relative to manual tightening of high pressure fittings.

Some embodiments may offer safe and consistent closing that increases the safety of the product. The precise screwing may be carried out for example in a pipeline for transporting hazardous materials at high pressures. A malfunction caused by a human error will result in system shutdown and leaks of hazardous substances. It is necessary to remove human errors from the control circuit and enable accurate mechanical tightening of the connectors.

Some embodiments provide the ability to monitor information such as tightening torque, locations of fitting components, number of closing rotations, and their respective angles.

Today, the tightening and reporting are completely manual and holding parts of the fitting immobile when manually closing might require another hand, and/or might deform the fitting which requires tightening.

According to another aspect, let-loker controls tightening of a fitting expressed as the number of rounds (or degrees) a first part of the fitting is rotated relative to a second part of the fitting. Some embodiments of let-loker also offer the ability to detect the correct positioning of the let-loker components relative to the fitting before starting the tightening activity. The angle is stored digitally.

A "fitting" is used in pipe systems to connect the straight pipe or tubing sections, adapt to different sizes or shapes and for other purposes, such as regulating (or measuring) fluid flow. "Plumbing" is generally used to describe the conveyance of water, gas, or liquid waste in domestic or commercial environments.

"Piping" is often used to describe the high-performance (high-pressure, high-flow, high-temperature or hazardous-material) conveyance of fluids in specialized applications.

"Tubing" is sometimes used for lighter-weight piping, especially that flexible enough to be supplied in coiled form.

Fittings (especially uncommon types) require money, time, materials and tools to install, and are an important part of piping and plumbing systems. Valves are technically fittings but are usually discussed separately.

"tool" refers to a device, apparatus or system, mechanical and/or electronic/electrical and/or optic, made of one or several components, for performing work on a workpiece.

"workpiece" is a term used herein and in the claims as an article upon which the tool may work. The workpiece is for example a fitting. "sealing" refers in the context of the workpiece to tightening components in the workpiece, to a predetermined extent, so that fluid can flow via the workpiece without leaks thereof.

"fastening head" is interchangeably referred to as "tightening head".

According to one aspect a tool is provided for sealing a workpiece, the workpiece comprising a first component and a second component sharing a rotation axis A, the tool comprising:

a fastening head capable of engaging the first component;

a first motor operationally coupled to the fastening head;

a controller capable of:

storing a rotation value representing rotation of the first component a predetermined desired angle around axis A;

measuring movement of the first component, and controlling movement of the first motor;

the tool, when the fastening head is engaged with the first component, and the second component is essentially immobilized from rotation around axis A, is configured to allow precisely sealing the workpiece by:

rotating the first component in a closing direction R toward the second component, according to the rotation value and under the control of the rotation by the controller.

In some embodiments the tool further comprises:

a gripping head capable of engaging the second component, and a second motor operationally coupled to the gripping head;

wherein engaging the gripping head with the second component and activating the second motor allow essentially immobilizing the second component to rotation around axis A.

Some embodiments have a default rotating rate 0.5-1 turn/s of the first component.

In some embodiments the second motor is capable of applying a force of at least 100 N on the second component in a direction opposite to the closing direction R while the tool is rotating the second component according to the prescribed rotation value.

In some embodiments the controller is further capable of storing and/or transmitting data related to the operation of the tool, said data comprising:

the rotation value and/or movement of the first motor and/or of the first component.

Some embodiments are further configured to allow moving the gripper along an axis essentially parallel to axis A.

In some embodiments the gripper is moved by the second motor.

In some embodiments said data further comprises one or more of the following:

position of the fastening head;

position of the gripping head;

torque applied by the fastening head;

force applied by the gripping head;

current angle of rotation around axis A; and

GPS location of the workpiece.

Some embodiments are configured to allow detecting a failure in sealing the workpiece and/or in loosening the fastened workpiece.

Some embodiments are further configured to allow sealing of the workpiece, after input of angle into the controller by a tool user.

Some embodiments are further configured to allow a specific sealing of a workpiece, based on a specific angle decided by the user/worker.

Some embodiments are further configured to allow changing grippers for different fittings.

In some embodiments the gripper is adjustable to engage various fittings.

In some embodiments the gripper is automatically adjustable.

Some embodiments are configured to allow the sealing with a single hand or no hands.

Some embodiments further comprise sensors operationally coupled to the first motor and thereby measuring movement of the first component.

Some embodiments are controlled by an electrical control panel that allows specific measurements and data transmitting in order to complete the fixation process.

According to another aspect a method of sealing a workpiece is provided, the workpiece comprising a first component and a second component sharing a rotation axis A, the method comprising:

storing a rotation value representing rotation of the first component a predetermined desired angle around axis A;

providing a fastening head;

engaging the fastening head with the first component;

gripping the second component;

the fastening head rotating the first component around axis A in a closing direction R toward the second component while the second component is immobilized against rotating around axis A;

measuring movement of the first component, and automatically ceasing the rotating when the measured movement of the first component is essentially equal to the stored rotation value.

Some embodiments further provide a gripping head capable of gripping the second component; the method further comprising:

immobilizing the gripping head from turning around axis A, and while the first component is being turned axis A in a closing direction R, automatically moving the gripping head along axis A in the direction of the first component.

This summary is provided to introduce a selection of concepts in a simplified form that are further described below in the Brief Description of the Figures and the Detailed Description. This summary is not intended to identify key features or essential features of the claimed subject matter, nor is it intended to be used to limit the scope of the claimed subject matter.

BRIEF DESCRIPTION OF THE DRAWINGS

The figures illustrate generally, by way of example, but not by way of limitation, various embodiments discussed in the present document.

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

The number of elements shown in the Figures should by no means be construed as limiting and is for illustrative purposes only.

Figure 1:
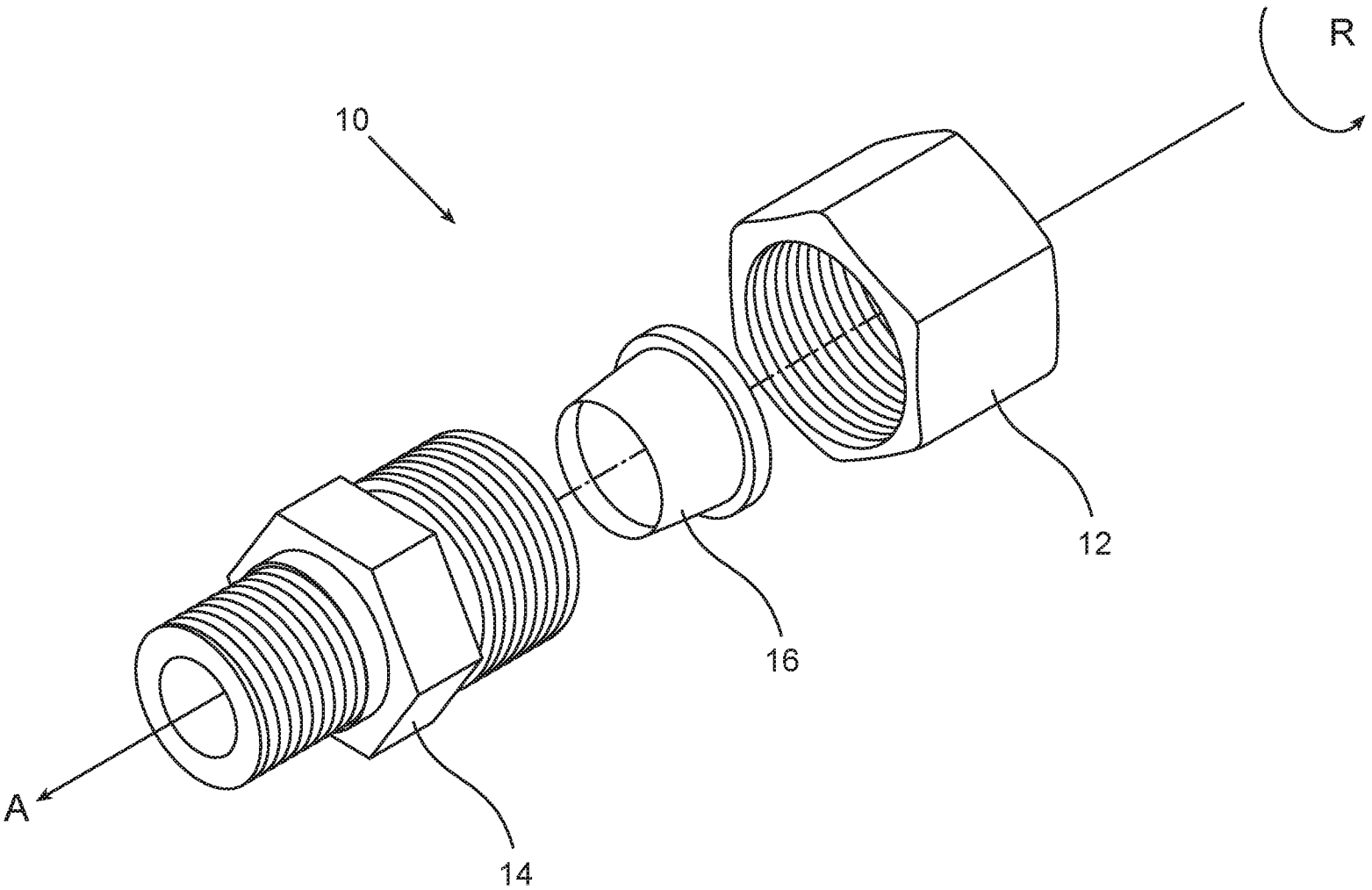
Figure 1 (Prior art)
Figure 2:
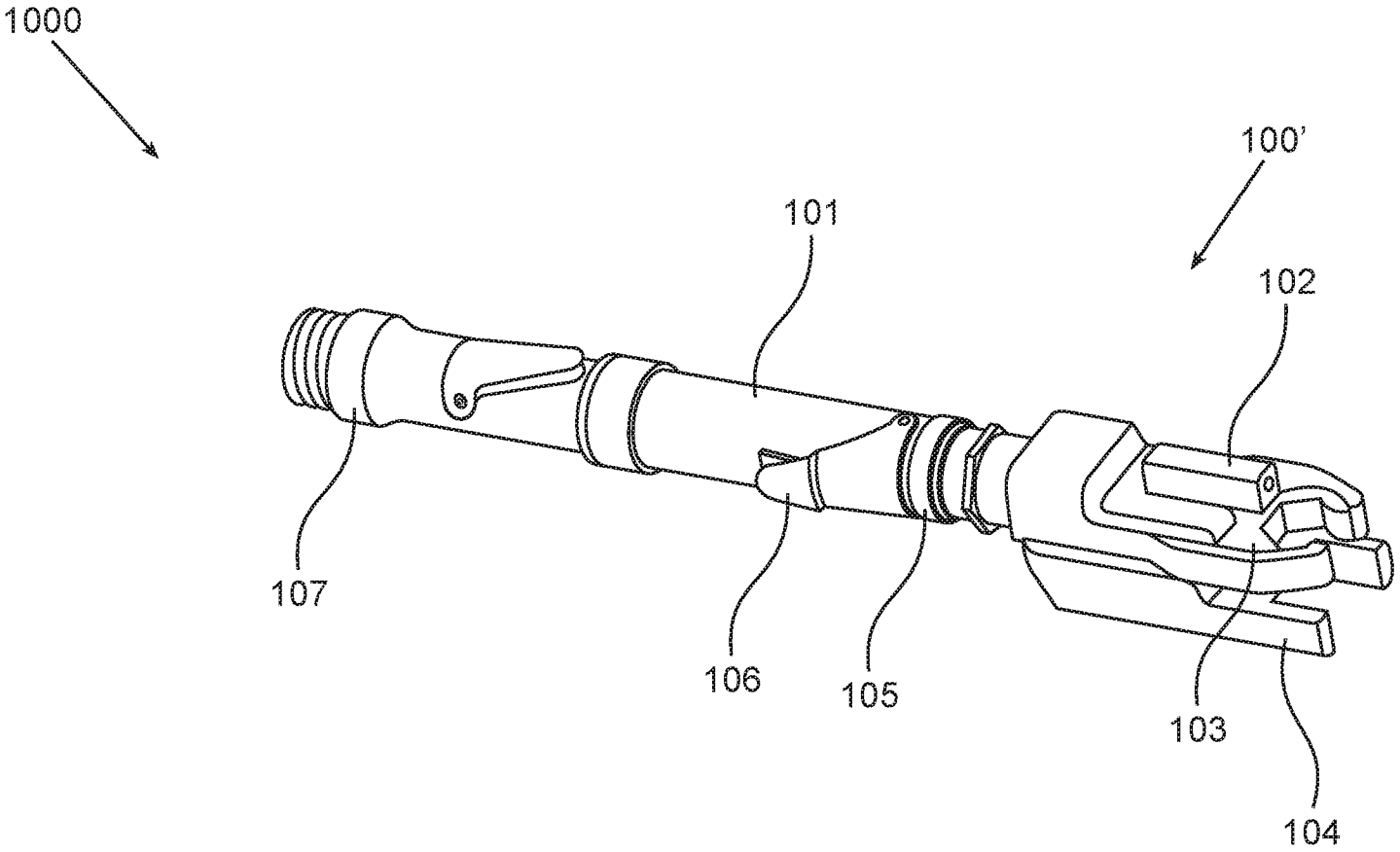

FIG. 1 is an exploded view of a fitting workpiece;

FIG. 2 is one perspective view of an improved handle embodiment, and

Figure 3:
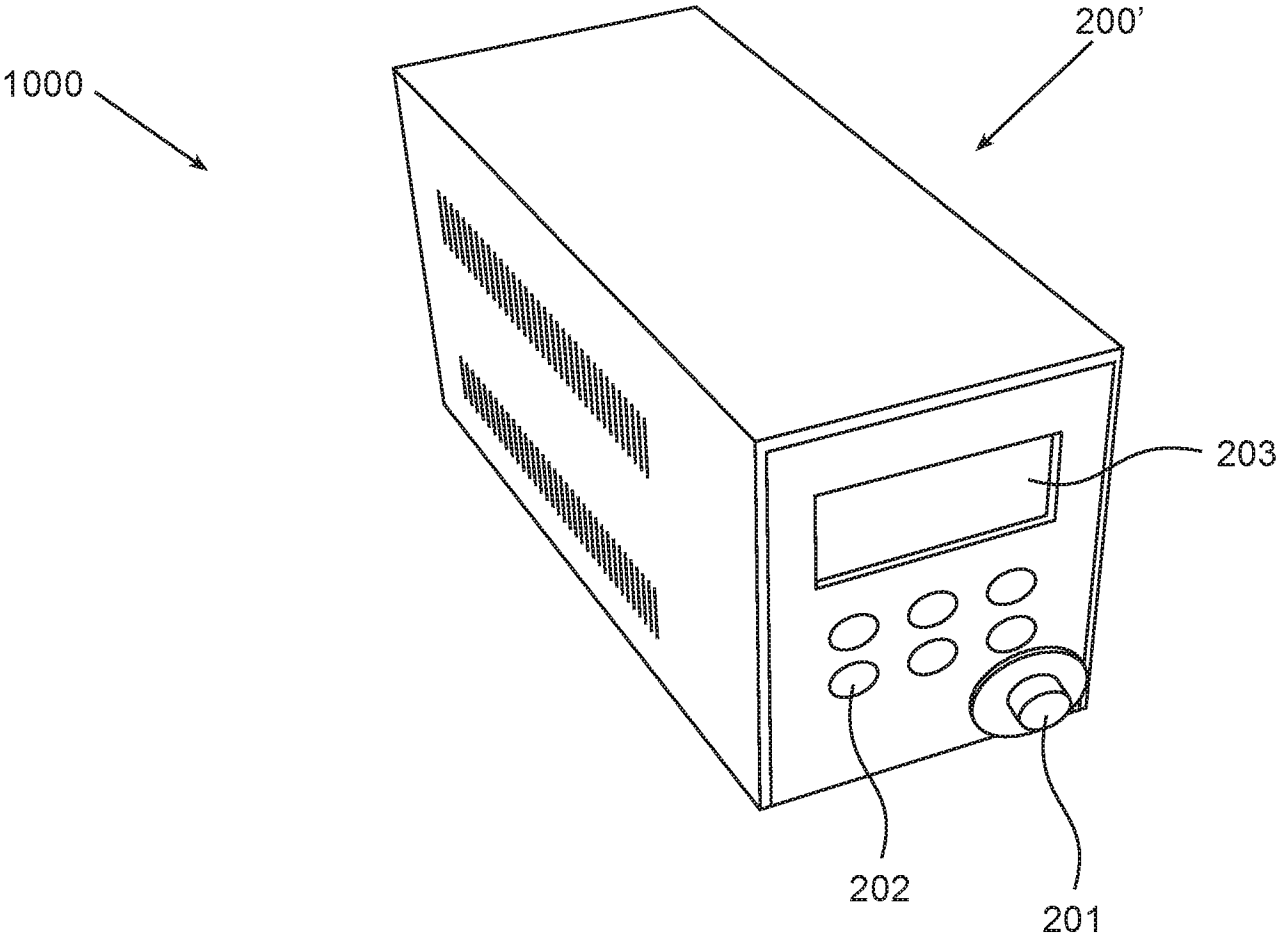
Figure 4:
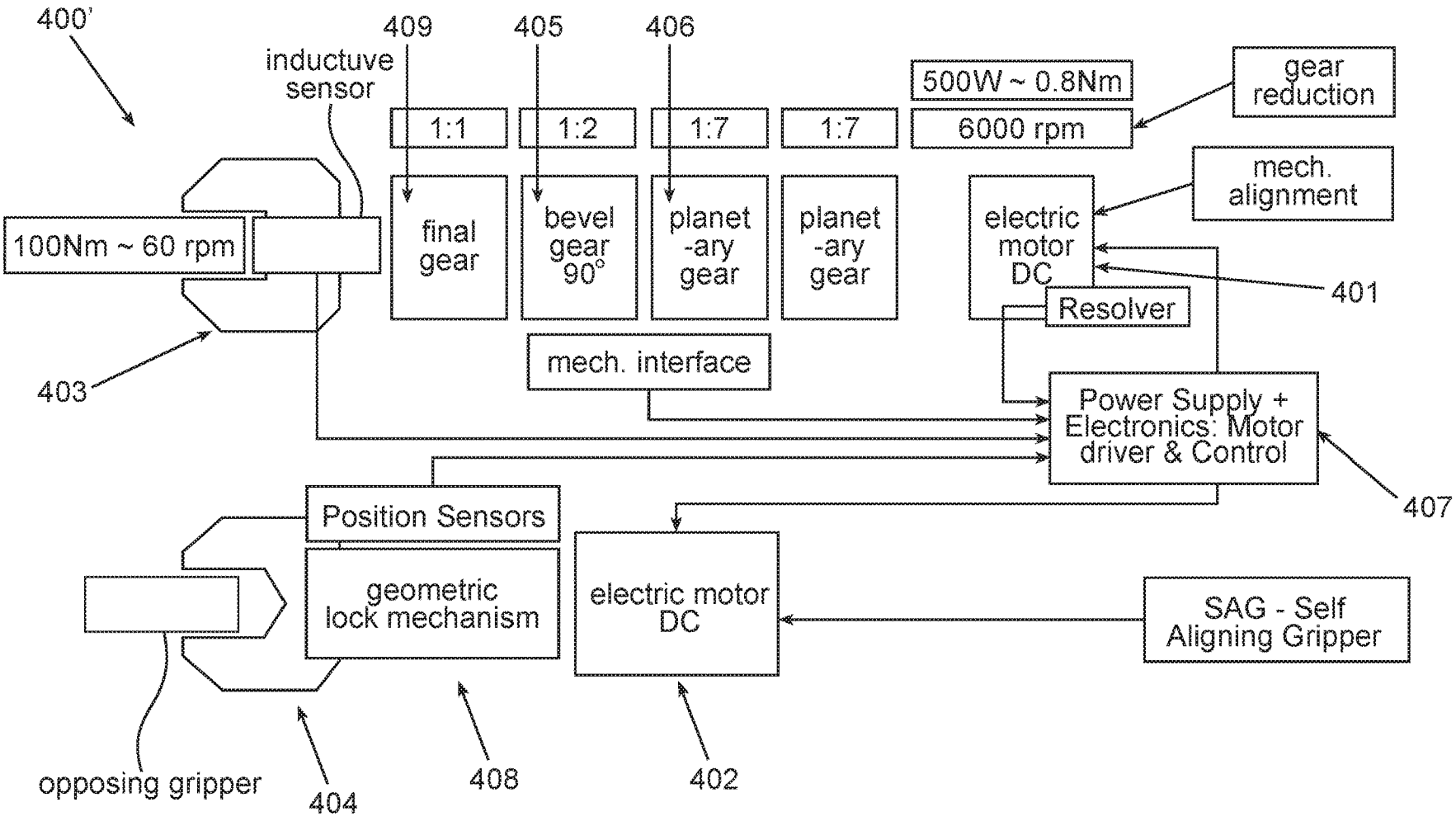

FIG. 3 is one perspective view of an improved electronic control that can be operationally coupled with the handle, and FIG. 4 is a block diagram of a tool embodiment.

Figure 5:
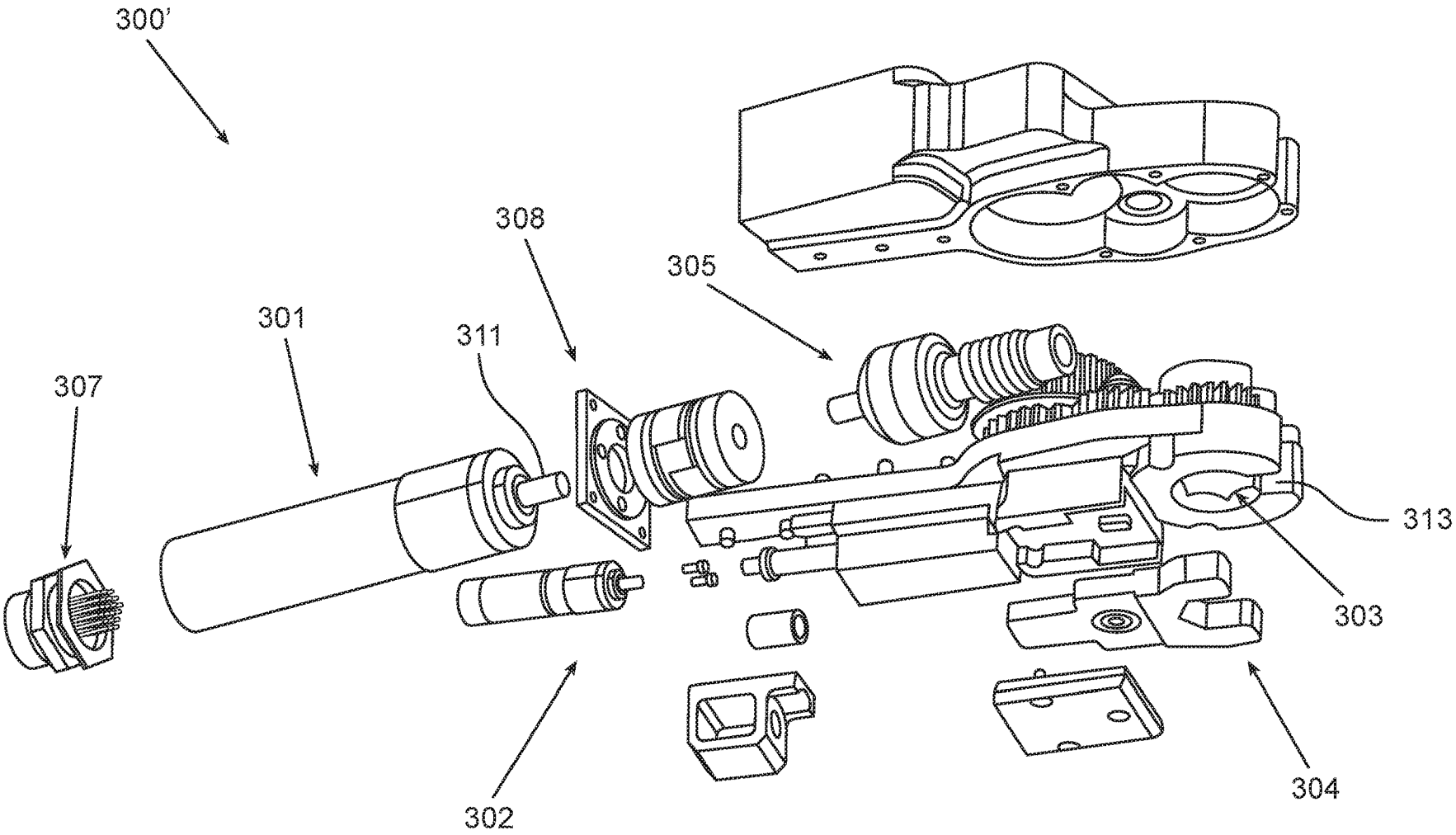

FIG. 5 is an exploded view of an improved handle embodiment, and

Figure 6:
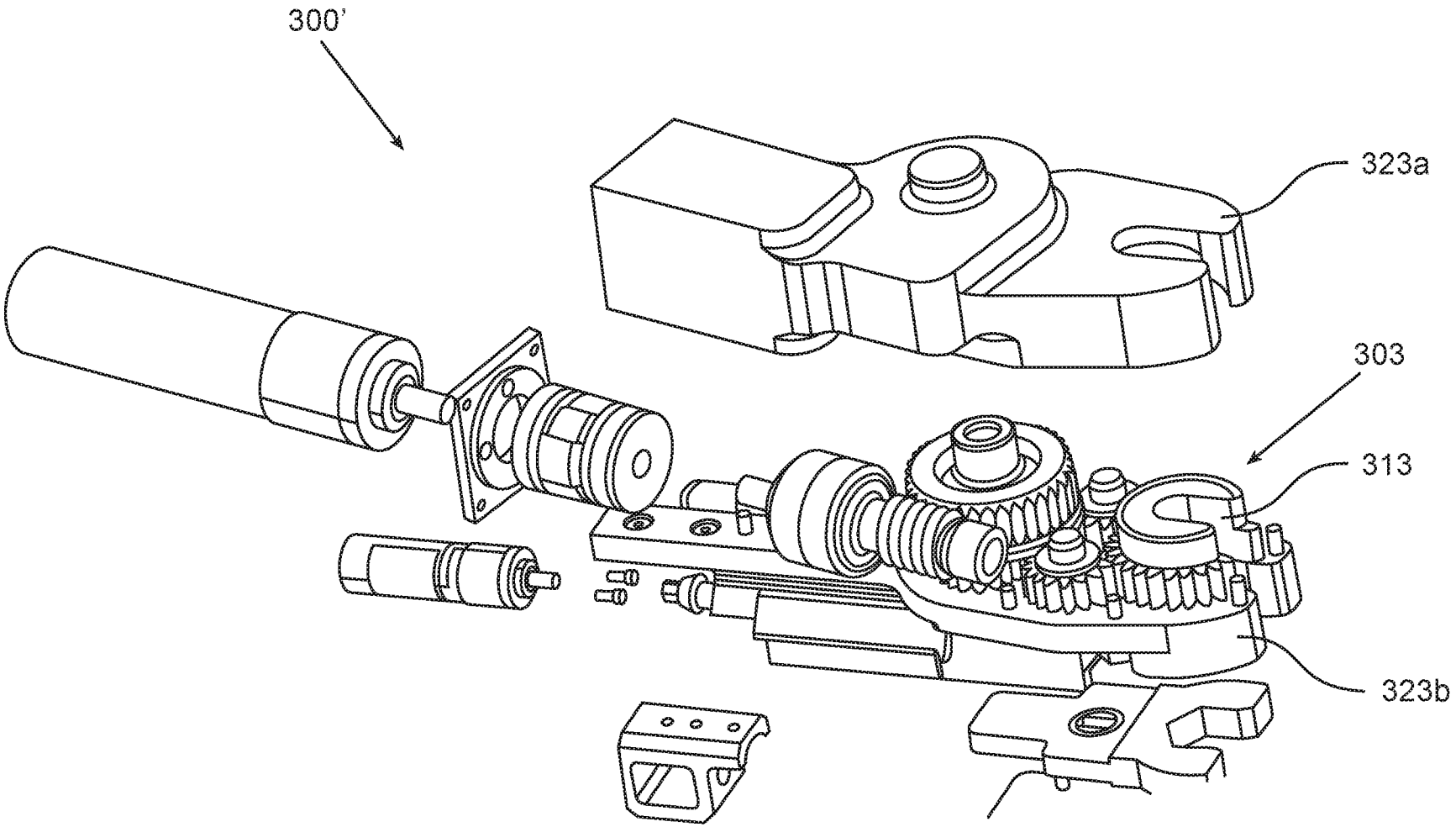

FIG. 6 is another exploded perspective view of the design illustrated in FIG. 5.

DETAILED DESCRIPTION OF THE EMBODIMENTS

FIG. 1 depicts a prior art high-pressure fitting 10. The fitting 10 is an example of a workpiece that may be subject to actions of tool embodiments described below.

The fitting 10 may include a first nut 12, or in general the workpiece 10 may include a first component 12 upon which the embodiments may operate. The fitting 10 may further include a second nut 14, or in general the workpiece 10 may include a second component 14 upon which the embodiments may operate. The fitting 10 may further include one or more ferrule 16. The components of the fitting 10 share a common rotation axis A.

Each of the first and second components 12, 14 typically engage a pipe end (not shown) and the fitting 10 should form a leak free connection between the two ends.

In order to tighten the fitting 10, the second nut 14 may be held immobile relative to rotation around axis A, whereas the first nut 12 is rotated around axis A in direction R.

FIG. 2 illustrates a schematic design of the "Handle" 100' of tool 1000. The handle 100' is an electrical driving and force employment device. The handle 100' has several main components including a Motor+Position Control body 101, an inductive sensor 102, a tightening head or fastening head 103, a Self-Aligning gripping head (SAG) 104, mechanical Transmitters 105, a two-handed operation part 106, and an electrical connector 107. The six parts 101-106 may be structured to engage with each other. The tightening head 103 is operationally connected to the mechanical transmitters 105. The mechanical transmitters 105 are screwed with the body 101. The electrical connector 107 is connected to cables (not shown) that will operationally couple the handle to the electronic control 200 of tool 1000 shown below in FIG. 3.

The handle 100' is the part of let-loker held by the employee at least during part of the use of the tool. Like other electrical devices in the industry, here too the worker is responsible for placing the handle in the correct location for the operation. The tightening head 103 is responsible for the mechanical rotation of a movable first part of a fitting, which may also be referred to as a connector, in the process. The SAG 104 is the part of the handle 100' that keeps the second component 14 of the fitting 10 at a fixed reference location and allows counting rotations/rotation angle of the first component 12 relative to the fixed reference location.

The position control 101 and the inductive sensor 102 may allow monitoring both the placing and the displacement of the tightening head 103.

A controller 200' may be further provided to control the operation of the handle 100'.

To summarize, according to one aspect, a tool 1000 is provided for sealing a workpiece 10,

- the workpiece 10 comprising a first component 12 and a second component 14 sharing a rotation axis A,
- the tool 1000 comprising:
  - a fastening or tightening head 103 capable of engaging the first component;
  - a first motor (not shown) operationally coupled to the fastening head 103;
  - a controller 200' capable of:
    - storing a rotation value representing a predetermined desired number of rotations around axis A;
    - measuring movement of the first component 12, and controlling movement of the first motor;
- the tool 1000, when the fastening head 103 is engaged with the first component 12, and the second component 14 is essentially immobilized from rotation around axis A, is configured to allow
- precisely sealing the workpiece 10 by:
  - rotating the first component 12 in a closing direction R, according to the rotation value and under the control of the rotation by the controller 200'.

The handle 100' typically has a maximum length of 550 mm and weighs a maximum of 3 kg.

Mechanical Connections:

The handle 100' may be connected to a cable in an IP65 sealed connection.

The tightening head 103 and SAG 104 in some exemplary embodiments enable engagement of the first and the second components 12, 14 of the fitting 10, each having a size ranging between ¼" [inch] and 1".

In some embodiments handle 100' and/or tightening head 103 and/or SAG 104 may be replaced by the field worker without the need for special tools other than Allen keys, in order to substitute the handle 100'/tightening head 103/SAG 104 with corresponding components having the same functionality as the counterpart component, but being of different size more suitable for the engagement of the first and/or second parts 12, 14 of the fitting 10.

In some embodiments the gripping head is easily detachable by the worker to allow the tool 1000 to work on fittings with NPT threading.

In some embodiments there are several gripping heads that have various shapes and sizing for working with various fittings. In some embodiments the grippers are easily replaceable by the user.

In some embodiments the tool is configured to allow moving the gripping head along an axis essentially parallel to axis A, and keeping the second component 14 immobilized relative to rotation around axis A. The movement may allow adjustment and setting of the tool to fittings having various distances of the fitting components from each other for example.

There is a great need to reduce the physical strength that a worker uses to close nuts in fittings. Automatic closing is required without the need for manual physical force and without marking with a marker the position of the nut before closing. The handle described above provides this and more. The handle has an automatic fixation of devices in order to prevent the use of excessive counterforce that can lead to mechanical distortions in the fitting.

Described in FIG. 3 is a schematic design of the monitoring electronic control 200' with an IP65 water-proof level. The electronic control has three major components including electrical connections 201, operation buttons 202, and an HMI screen 203. The Handle 100' may be operationally and detachably connected via a cable to the electronic control 200'. Such cable is typically at least 5 m long to allow flexibility and convenience in positioning the controller 200' relative to the handle 100'.

Operation:

- The controller 200' will enable the handle 100' to be turned on and off.
- Various operating programs will be selected in the operating screen 203.
- In some embodiments controller 200' can be carried with one hand. The controller 200' may further comprise a suitable carrying handle (not shown).
- In some embodiments the controller 200' further comprises at least three feet (not shown), each optionally further comprising pads (not shown) to prevent slipping. The controller may stand on the legs.

Electrical Connections

The electrical connections may comprise one or more of the following components:

- An electrical connection from the PLC itself operationally coupled to an electrical power supply network. In some embodiments the electrical coupling is permanent.

A connector for operationally connecting a grounding cable to the controller 200'.

A connector for connecting the controller 200' to an RJ45 network cable which enables diagnostics and software burning and or/uploading using an external computer.

We have discovered that the rotation is optimally between 0.5 and 1 turns per second. Faster rotation may, at least in some fittings, reduce the precision of the tightening, whereas slower rotation may reduce the advantage of the fast tightening without appreciable precision improvement.

By "turn" is meant a rotation of 360 degrees (a full cycle).

Accordingly, in some embodiments the let-loker is configured to allow the rotation to occur within the optimal range.

In some other embodiments the rotation within the optimal range is default, and a rotation velocity outside the optimal range may be user-selectable from the handle and/or controller. Some of the embodiments may be configured to allow emission of a warning signal when a non-optimal rotation velocity is selected, or in particular embodiments when the velocity is substantially faster e.g., 5 rotations/s.

In some embodiments one of various rotation velocities may be selected from within the optimal range.

Some let-loker embodiments have a handle that includes a tightening head and a SAG, Self-Aligning Gripping head. The tightening head is configured to allow automatically engaging the let-loker handle with a first component of a fitting, such that the first component is immobilized at a first position, and the SAG is configured to allow engaging the let-loker handle with a second component of the fitting, such that the second component can be non-manually controllably rotated with respect to the first component.

By referring to "automatically" performing a step it is meant that the step is carried out without human intervention, in particular no manual force is employed in the step.

According to another aspect, a process for a tool-assisted tightening of a fitting is provided. The process includes let-loker engaging and disengaging steps, and tightening steps.

According to yet another aspect, let-loker will detect a disconnection status from the tightening head after the tightening is completed and return to a "zero" state, wherein the tightening head and the SAG are both opened.

Some let-loker embodiments are further configured to allow non-manual loosening of fittings.

Some embodiments of let-loker are capable of detecting a failure in a controlled fitting tightening/loosening process when the tightening fails to complete a set tightening/loosening order.

Some let-loker embodiments may further be designed to be capable of disassembling and replacing parts not manufactured by the manufacturer after appropriate technical training.

Some let-loker embodiments are designed to operate without maintenance, for at least 100,000 cycles.

Some let-loker embodiments comprise 3 main parts/subsystems:

An electrically powered tool that contains a power-operated drive and a power transmission and the tightening head and the SAG, a "handle".

2) Control system: A command and control box connected to the above tool and capable of controlling its operation, hereinafter referred to as "controller".

3) a location feedback using encoder data from the motor or from sensors in or on the handle imparting the controller 200' the ability to stop the rotations and correctly close the first component 12.

In some embodiments said data further comprises one or more of the following:

position of the fastening head;

position of the gripping head;

torque applied by the fastening head;

force applied by the gripping head;

current angle of rotation around axis A; and

GPS location of the workpiece.

Such data may be received from sensors situated on and/or in the handle 100' that may include magnetic and inductive sensors for the location of the fastening head and the gripping head. The data may be sent to a cloud and/or PLC for further control and surveillance of the operation and operational conditions, and some of the data may be used as feedback to control the operation of the tool.

A power and control cable may reversibly connect the two above elements 100' and 200', referred for simplicity sake below as "cable". In some embodiments the handle 100' is inoperable if not connected to the controller 200' via the cable.

The let-loker may turn a blind threaded element with respect to a fixed base a predetermined number of turns, lock a device to a fixed location which has a known position in relation to a controlled tightening device, and provide an electrically controlled robotic process by which the above physical operations can be achieved.

In some embodiments the controller 200' allows running specific software capable of controlling the sequence of actions performed by the handle 100'.

Control software for each component of the handle 100' may be written as separate and independent blocks (subroutines).

In some embodiments the software may be encoded in a modular way that enables the insertion of future additional features as part of the sequence of actions.

Data communication between the controller 200' and external computer/s may be enabled over a Wi-Fi network to a central database.

BLE data communication with mobile devices may be configured to allow performing any one or more of the following purposes:

Operating a user interface through a dedicated application

Performing technical diagnostics

In some embodiments mechanical operation of the handle 100' is only allowed when the handle 100' is operationally connected through a dedicated cable to the electronic controller 200'.

In some embodiments the handle 100' is detachable from the cable. The cable is not an integral part of the handle 100'.

Replacing the tightening head 103 with one of another size can be easily done by the operator. Replacing the fixed SAG head 104 to a different size or geometry can be done by the operator.

In some embodiments the handle 100' further comprises a selector button (not shown).

Controlled mechanical operation of the handle 100' may be possible in two situations:

1) Selector in automatic mode: Operation will require holding the handle 100' with both hands and performing a preset sequence of operations.

2) Selector in manual mode: Two-hand operation where every click is responsible of one of the operations mentioned above.

The automatic mode is useful in maximizing the time efficiency of the let-loker comprising the handle 100' and the controller 200'. The manual mode is useful for training inexperienced personnel, troubleshooting the tightening, optimizing the tightening and for other purposes.

The selector button may be operationally coupled to the controller 200' such that the controller sends operating instructions to the handle 100' according to the setting of the selector on the handle 100'.

A block diagram of a tool embodiment 400' is described in FIG. 4. This figure describes the work flow of the tool. Two electric motors 401 and 402 are electrically operated by the power supply 407.

The first motor 401 is directly connected to the power supply 407.

The first motor 401 is connected to a set of gears:

Planetary gear 406.

Bevel gear 405.

Final gear 404.

These gears are set to rotate the fastening head while the lower part of the tool is immobilized.

The second motor 402, is coupled to the gripping head 403. The gripping head 403 is locked using a geometric lock mechanism 408 which keeps the gripping head 403 from moving while the fastening head rotates.

An exploded perspective view of the design of an improved handle 300' is described in FIG. 5. The handle has an electrical connector 307. This connector 307 is directly connected to a first motor 301. The first motor 301 is connected to internal gears 305. the gears rotate the fastening head 303.

There is an encoder 308 that is coupled to the first motor 301. The encoder allows measurement of the angle of the tightening. The encoder is for example an inductive absolute rotary encoder.

There is no need for compliant or special couplings and the inductive encoder can simply e screwed to the host product. Precise mechanical mounting is not required and there are no bearings.

Rotary encoders collect data and send feedback based on the rotation of the object/the rotating device. It can convert the first component's angular position (not shown) based on the rotation of the first motor's shaft 311. When the shaft 311 rotates, a unique code pattern is produced, each position of the shaft has a pattern and this pattern is used to determine the exact rotation value. This kind of encoders ensures high safety and accuracy because the encoder can accurately determine the position based on the unique pattern.

A second motor 302 is coupled to the gripping head 304. The second motor 302 is limited in motion in a direction essentially perpendicular to a plane defined by the motion of the fastening head 303 (up and down in the figure).

The tool 300' can control the rotation angle itself no matter what the torque of the applied force is.

The gripper motor (second motor) applies a counter force of more than 100 N to oppose the force applied by the fastening motor and keep the second component (nut) immobile.

As the fitting closes (is tightened), the position of the second component changes in the direction of axis A and so the second motor 302 changes the vertical position of the gripping head 304 to closer to the fastening head 303.

The second motor 302 is designed to raise the gripping head 304 to the correct position that allows a better grip of the workpiece (not shown).

The second motor 302 can be moved to distance the gripping head 304 from the fastening head 303 which will also allow removing the tool 300' after sealing the workpiece. An easy removing of the tool after using it, allows a more effective work environment where no more than one operator is required.

Another exploded perspective view of the improved handle 300' embodiment is described in FIG. 6.

The tool 300' further comprises protective covers 323*a*, 323*b* that protect a user from contact with the gears and fastening head 303. The covers 323*a*, 323*b* are further shaped to allow guiding a first component of a workpiece to the fastening head 303.

The fastening head 313 has an opening 313 that further guides the first component into engagement with the fastening head 303. The tool 300' as shown is in a resting state before a first component has been introduced.

After the first component has been introduced the opening of 313 fastening head 303 moves together with movement of the fastening head 303 such that if the value of the rotation is not an integer number of turns, such as a turn and a quarter (450°), it is not possible to disengage the tool 300' from the workpiece. Therefore, the tool 300' may further comprise a component that allows freeing the fastening head 313 from the workpiece, such as a ratchet mechanism incorporated into the internal gears 305, which can be activated by the controller (not shown in the figure) upon reaching the rotation value or being prompted to do so by a user.

It will be appreciated that other embodiments may significantly depart from the illustrated structures and perform similar operations to the same effect, subject to the scopes of the claims, but all of these other embodiments are to the best of our knowledge presently unknown and are not commercially available.

The counter force needs to be more than 100 N in order to deal with fittings that are hardest to close.

The tool as a part of the electronic system, allows a fully electronic fixation of connectors in a specific angle. This tool allows an easier and more precise fixation of the connector.

The tool provides an automatic measuring a specific angle of rotation and an automatic storing of the measurements of the rotation angles. This feature is essential to reduce need for additional workers and more attention can be given to the workpiece rather than measuring the specific angles.

There is a natural distribution of the torque that is required to close apparently identical fittings.

Removing the wrench after closing has various possibilities:

It can use a screwing mechanism that can withdraw the gripping head and then can freely rotate the wrench to let the fastening head be free to come off.

In alternative arrangements there is a ratcheting mechanism that allows to free up the fastening head.

This tool allows a safe fixation of the nuts, an easy removing of the tool after using it. This allows a more effective work environment where no more than one operator is required. The tool is further configured to allow a specific fixation of a connector, based on a specific number of turns/a specific angle. In some embodiments the tool has the ability to change gripping heads and/or fastening heads for different fittings. This allows a wide range of usage for several kinds of fittings/workpieces/connectors/nuts.

In other embodiments the tool can also be adjustable for various fittings. This feature allows connecting to different kinds and sizes of workpieces such as connectors/nuts without the need for several fastening heads/gripping heads for this matter. It will minimize the amount of spare parts and storage place is needed for these parts. Such heads have for example an adjustable structure akin to an adjustable camera lens.

The handle of the tool described above provides an automatic and easy fixation without the need for physical force. The handle has an automatic fixation where that is controlled by sensors that know the precise angle or force is required for a precise fixation of the nut/connector. The worker can decide the angle/number of turns/required torque, in advance. The tool is controlled by an electrical control panel that allows specific measurements and information about the sealing of the connector. These specific data allow an ideal closing without or with a minimal damaging of the connector.

The following is an exemplary method to close a fitting using let-loker:

A. The worker loosely assembles the required fitting that includes a first component and a second component, wherein the first component is alternatively referred to as a fixed nut, and a second component which is alternatively referred to below as a rotatable nut.

B. The worker manually locks the nut in the fitting with finger force only according to.

F.F.F.T.=Flats From Finger Tight or T.F.F.T.=Turns From Finger Tight

C. The worker engages the handle 100' with the fixed and rotatable nuts.

D. The employee presses a start button (not shown) on the handle and let-loker performs the following steps in sequence:

The automatic gripping head 104 engages the fixed nut

The fastening head 103 engages the rotatable nut and performs several rounds according to a predetermined plan.

Automatic Gripping head Release.

Indicating to the employee that the clamping activity is complete (visual/voice/and or vibratory).

D. The worker raises the handle 100' slightly so that the fastening head 103 is no longer engaged with the rotatable nut that has just been tightened.

E. The worker releases the power button.

F. In order to release the handle 101', another automatic action is performed: turning the tightening head 103 back to a releasable position, that is, back to the initial position where the tightening head 103 has the form of a regular open spanner.

G. The worker can remove the handle 100' from the fitting and move to the next fitting.

In some embodiments let-loker will enable the closing of ferrules at torques of up to 240 Nm.

In some embodiments closure of a gripping head 104 on a fixed nut to prevent rotation during tightening (lock position) shall be done by a force of not less than 100 N.

The gripping head 104 in the lock position may withstand opening forces generated by the closing action of the tightening head 103.

In some embodiments let-loker will be designed to operate without a hitch in a workload of 600 work cycles in an 8-hour shift with a minimum break time between cycles of 30 seconds.

Some let-loker embodiments may be sealed at the level of IP65 in electronic parts, electrical connectors and control system. In some embodiments sealing of the mechanical parts is provided at a level of IP50. Typically dust or water will not interfere with normal operation but their penetration into the mechanical system is possible.

FIG. 4 is a block diagram of a tool embodiment 400'.

The transmission to the tightening head 403 includes an electric motor 401, planetary gears 406 and bevel gears 405 such as crown gears, and other toothed final gears 409 for transmission.

In some embodiments the transmission to the gripping head 404 includes an electric motor 401, a geometric lock mechanism 408 such as a worm gear.

The controller 407 may provide power supply, electronics, a motor driver and control to the electric motors 401, 402 and receive feedback from the electric motor 401, the gears 404, 405, 406 the lock mechanism 408, an inductive sensor operationally coupled to the tightening head 403 and position sensors operationally coupled to the gripping head 404.

At present we believe that these embodiments operate best, but the other embodiments are also satisfactory.

Clarifications about Terminology

In the discussion, unless otherwise stated, adjectives such as "substantially" and "about" that modify a condition or relationship characteristic of a feature or features of an embodiment of the invention, are to be understood to mean that the condition or characteristic is defined to within tolerances that are acceptable for operation of the embodiment for an application for which it is intended.

It should be noted that the term "item" as used herein refers to any physically tangible, individually distinguishable unit of packaged or unpackaged good or goods. Positional terms such as "upper", "lower" "right", "left", "bottom", "below", "lowered", "low", "top", "above", "elevated", "high", "vertical" and "horizontal" as well as grammatical variations th3ereof as may be used herein do not necessarily indicate that, for example, a "bottom" component is below a "top" component, or that a component that is "below" is indeed "below" another component or that a component that is "above" is indeed "above" another component as such directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

"Coupled with" means indirectly or directly "coupled with".

It is important to note that the methods described above are not limited to the corresponding descriptions. For example, the method may include additional or even fewer processes or operations in comparison to what is described herein and/or the accompanying figures. In addition, embodiments of the method are not necessarily limited to the chronological order as illustrated and described herein.

It should be understood that where the claims or specification refer to "a" or "an" element or feature, such reference is not to be construed as there being only one of that element. Hence, reference to "an element" or "at least one element" for instance, may also encompass "one or more elements".

Unless otherwise stated, the use of the expression "and/or" between the last two members of a list of options for selection indicates that a selection of one or more of the listed options is appropriate and may be made.

It is noted that the term "perspective view" as used herein may also refer to an "isometric view" and vice versa.

It should be appreciated that certain features which are, for clarity, described in the context of separate embodiments, may also be provided in combination in a single embodiment. Conversely, various features, which are, for brevity, described in the context of a single embodiment, example and/or option, may also be provided separately or in any suitable sub-combination or as suitable in any other described embodiment. Certain features described in the context of various embodiments are not to be considered essential features of those embodiments, unless the embodiment, example, and/or option are inoperative without those elements. Accordingly, features, structures, characteristics, stages, methods, modules, elements, entities or systems disclosed herein, which are, for clarity, described in the context of separate examples, may also be provided in combination in a single example. Conversely, various features, structures, characteristics, stages, methods, modules, elements, entities or systems disclosed herein, which are, for brevity, described in the context of a single example, may also be provided separately or in any suitable sub-combination.

It is noted that the term "exemplary" is used herein to refer to examples of embodiments and/or implementations and is not meant to necessarily convey a more desirable use-case.

In alternative and/or other embodiments, additional, fewer, and/or different elements may be used.

Throughout this description, various embodiments may be presented in a range format. It should be understood that the description in range format is merely for convenience and brevity and should not be construed as an inflexible limitation on the scope of the embodiments. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include—where applicable—any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

While the aspects have been described with respect to a limited number of embodiments, these should not be construed as scope limitations, but rather as exemplifications of some of the embodiments.

The invention claimed is:

1. A tool for sealing a workpiece, the workpiece comprising a first component and a second component sharing a rotation axis A, the tool comprising:

a fastening head capable of engaging the first component;

a first motor operationally coupled to the fastening head;

a controller capable of:

storing a rotation value representing rotation of the first component a predetermined desired angle around axis A;

measuring movement of the first component, and controlling movement of the first motor;

the tool, when the fastening head is engaged with the first component, and the second component is essentially immobilized from rotation around axis A, is configured to allow precisely sealing the workpiece by:

rotating the first component in a closing direction R toward the second component, according to the rotation value and under the control of the rotation by the controller;

a gripping head capable of engaging the second component, and a second motor operationally coupled to the gripping head; wherein engaging the gripping head with the second component and activating the second motor allow essentially immobilizing the second component to rotation around axis A.

2. The tool of claim 1, wherein the controller is further capable of storing and/or transmitting data related to the operation of the tool, said data comprising:

the rotation value and/or movement of the first motor and/or of the first component.

3. The tool of claim 2, said data further comprising one or more of the following:

position of the fastening head;

position of the gripping head;

torque applied by the fastening head;

force applied by the gripping head;

current angle of rotation around axis A; and

GPS location of the workpiece.

4. The tool of claim 2, configured to allow detecting a failure in sealing the workpiece and/or in loosening the fastened workpiece.

5. The tool of claim 2, further configured to allow a specific sealing of a workpiece, based on a specific angle decided by the user/worker.

6. The tool of claim 2, further configured to allow changing grippers for different fittings.

7. The tool of claim 2, controlled by an electrical control panel that allows specific measurements and data transmitting in order to complete the fixation process.

8. The tool of claim 1, further configured to allow moving the gripper along an axis essentially parallel to axis A.

9. The tool of claim 8, wherein the gripper is moved by the second motor.

10. The tool of claim 1, further configured to allow sealing of the workpiece, after input of angle into the controller by a tool user.

11. The tool of claim 1, wherein the gripper is adjustable to engage various fittings.

12. The tool of claim 11, wherein the gripper is automatically adjustable.

13. The tool of claim 1, configured to allow the sealing with a single hand or no hands.

14. The tool of claim 1, further comprising sensors operationally coupled to the first motor and thereby measuring movement of the first component.

15. A method of sealing a workpiece, the workpiece comprising a first component and a second component sharing a rotation axis A, the method comprising:

storing a rotation value representing rotation of the first component a predetermined desired angle around axis A;

providing a fastening head;

engaging the fastening head with the first component;

gripping the second component;

the fastening head rotating the first component around axis A in a closing direction R toward the second component while the second component is immobilized against rotating around axis A;

measuring movement of the first component, automatically ceasing the rotating when the measured movement of the first component is essentially equal to the stored rotation value;

providing a gripping head capable of gripping the second component;

immobilizing the gripping head from turning around axis A; and while the first component is being turned axis A in a closing direction R, automatically moving the gripping head along axis A in the direction of the first component.

16. The method of claim 15, further comprising calibrating the movement of the gripping head along axis A according to predetermined thread dimensions of the workpiece.

17. The method of claim 15, further comprising providing a first motor operationally coupled to the fastening head; the method further comprising:

calibrating the movement of the first motor according to the rotation of the first component;

measuring the movement of the first motor during the rotation of the first component;

measuring movement of the first component according to the measurement of the movement of the first motor.

* * * * *